US009042779B2

(12) United States Patent
Kogure et al.

(10) Patent No.: US 9,042,779 B2
(45) Date of Patent: May 26, 2015

(54) TRANSFER BELT DEVICE AND IMAGE FORMING APPARATUS INCLUDING THE SAME

(71) Applicants: Seiichi Kogure, Kanagawa (JP); Katsuhito Haruno, Kanagawa (JP); Hiroki Nakamatsu, Kanagawa (JP); Kazuki Yogosawa, Tokyo (JP)

(72) Inventors: Seiichi Kogure, Kanagawa (JP); Katsuhito Haruno, Kanagawa (JP); Hiroki Nakamatsu, Kanagawa (JP); Kazuki Yogosawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 68 days.

(21) Appl. No.: 13/765,063

(22) Filed: Feb. 12, 2013

(65) Prior Publication Data

US 2013/0216260 A1 Aug. 22, 2013

(30) Foreign Application Priority Data

Feb. 21, 2012 (JP) ..... 2012-035562

(51) Int. Cl.
*G03G 15/16* (2006.01)
*G03G 15/01* (2006.01)

(52) U.S. Cl.
CPC ..... *G03G 15/1615* (2013.01); *G03G 15/0131* (2013.01); *G03G 2215/0158* (2013.01)

(58) Field of Classification Search
USPC ..... 399/121, 308
See application file for complete search history.

(56) References Cited

U.S. PATENT DOCUMENTS

| | | | | |
|---|---|---|---|---|
| 4,178,094 | A * | 12/1979 | Silverberg | 399/165 |
| 5,784,676 | A * | 7/1998 | Iseki et al. | 399/301 |
| 6,185,394 | B1 * | 2/2001 | Lee | 399/116 |
| 6,445,895 | B2 * | 9/2002 | Shirasawa et al. | 399/116 |
| 6,865,361 | B2 * | 3/2005 | Abe et al. | 399/302 |
| 7,079,790 | B2 * | 7/2006 | Ozawa et al. | 399/164 |
| 7,162,192 | B2 * | 1/2007 | Yamada et al. | 399/302 |
| 7,369,793 | B2 * | 5/2008 | Kumazawa | 399/121 |
| 7,627,268 | B2 * | 12/2009 | Katoh et al. | 399/121 |
| 7,668,491 | B2 * | 2/2010 | Furuya et al. | 399/302 |
| 7,941,074 | B2 * | 5/2011 | Nakagaki | 399/121 |
| 7,986,903 | B2 * | 7/2011 | Park | 399/121 |
| 8,103,190 | B2 * | 1/2012 | Ohkushi et al. | 399/121 |
| 8,126,365 | B2 * | 2/2012 | Nishida et al. | 399/165 |
| 8,774,687 | B2 * | 7/2014 | Shimizu et al. | 399/302 |
| 2001/0051059 | A1 * | 12/2001 | Morikami et al. | 399/121 |
| 2004/0228653 | A1 * | 11/2004 | Yoshino | 399/121 |
| 2005/0074259 | A1 * | 4/2005 | Tachiki et al. | 399/121 |

(Continued)

FOREIGN PATENT DOCUMENTS

| | | |
|---|---|---|
| JP | 9-114266 | 5/1997 |
| JP | 2002-014570 | 1/2002 |

(Continued)

*Primary Examiner* — G. M. Hyder
(74) *Attorney, Agent, or Firm* — Harness, Dickey & Pierce

(57) ABSTRACT

An image forming apparatus includes a housing and a transfer unit. The transfer unit detachably attachable relative to the housing includes a drive roller, a driven roller disposed opposite the drive roller, a belt formed into a loop and entrained around the drive roller and the driven roller, a frame to support the shaft of the drive roller, and a support member to movably support the shaft of the driven roller to be parallel to an axial direction of the drive roller and movable in a first direction different from the axial direction. A positioning member disposed in the housing holds the shaft of the drive roller parallel, and a restriction member restricts movement of the driven roller in the first direction to keep the shaft of the driven roller parallel to the shaft of the drive roller as the transfer unit is mounted in the image forming apparatus.

19 Claims, 8 Drawing Sheets

(56) References Cited

U.S. PATENT DOCUMENTS

| | | | | |
|---|---|---|---|---|
| 2005/0158074 | A1* | 7/2005 | Murakami et al. | 399/121 |
| 2007/0025762 | A1* | 2/2007 | Kato et al. | 399/121 |
| 2007/0048005 | A1* | 3/2007 | Nakano et al. | 399/110 |
| 2007/0048010 | A1* | 3/2007 | Nakano | 399/121 |
| 2007/0147891 | A1* | 6/2007 | Mori | 399/121 |
| 2007/0177894 | A1* | 8/2007 | Nakano et al. | 399/121 |
| 2008/0124120 | A1* | 5/2008 | Kang | 399/121 |
| 2008/0260424 | A1* | 10/2008 | Hara et al. | 399/121 |
| 2008/0310891 | A1* | 12/2008 | Mochizuki | 399/302 |
| 2009/0035038 | A1 | 2/2009 | Sugimoto et al. | |
| 2009/0092428 | A1 | 4/2009 | Yano et al. | |
| 2009/0257799 | A1 | 10/2009 | Haruno et al. | |
| 2009/0304426 | A1* | 12/2009 | Nakagaki | 399/400 |
| 2009/0311004 | A1 | 12/2009 | Naruse et al. | |
| 2010/0003051 | A1 | 1/2010 | Sekina et al. | |
| 2010/0003052 | A1 | 1/2010 | Nakamatsu et al. | |
| 2010/0008696 | A1 | 1/2010 | Furuya et al. | |
| 2010/0008706 | A1 | 1/2010 | Sugiura et al. | |
| 2010/0034549 | A1 | 2/2010 | Nakamatsu et al. | |
| 2010/0067952 | A1 | 3/2010 | Fujita et al. | |
| 2010/0080625 | A1 | 4/2010 | Furuya et al. | |
| 2010/0239302 | A1 | 9/2010 | Naruse et al. | |
| 2011/0058859 | A1 | 3/2011 | Nakamatsu et al. | |
| 2011/0150529 | A1* | 6/2011 | Ohkushi et al. | 399/121 |
| 2011/0158689 | A1* | 6/2011 | Yamaguchi | 399/121 |
| 2011/0188890 | A1* | 8/2011 | Hoshino et al. | 399/121 |
| 2011/0211855 | A1 | 9/2011 | Kogure et al. | |

FOREIGN PATENT DOCUMENTS

| | | |
|---|---|---|
| JP | 2007-183561 | 7/2007 |
| JP | 2007-316218 | 12/2007 |
| JP | 2011-112912 | 6/2011 |

* cited by examiner

TRANSFER BELT DEVICE AND IMAGE FORMING APPARATUS INCLUDING THE SAME

CROSS-REFERENCE TO RELATED APPLICATIONS

This patent application is based on and claims priority pursuant to 35 U.S.C. §119 to Japanese Patent Application No. 2012-035562, filed on Feb. 21, 2012, in the Japan Patent Office, the entire disclosure of which is hereby incorporated by reference herein.

BACKGROUND OF THE INVENTION

1. Field of the Invention

Exemplary aspects of the present invention generally relate to an image forming apparatus, such as a copier, a facsimile machine, a printer, or a multi-functional system including a combination thereof, and more particularly to, a transfer device using a belt-type transfer member employed in the image forming apparatus.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photosensitive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; a transfer device transfers the toner image directly from the image bearing member onto a recording medium (in a direct transfer method) or indirectly transfers from the image bearing member onto a recording medium via an intermediate transfer member (in an intermediate transfer method); a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

The transfer device is generally equipped with a belt member such as an intermediate transfer belt onto which the toner image is transferred from the image bearing member and a conveyor belt disposed opposite the image bearing member, to carry a recording medium and transfer the toner image to the recording medium. Such belt members are formed into an endless loop and entrained around a plurality of rollers, and move in a certain direction (belt moving direction). While moving, the belt members often drift undesirably out of alignment towards a direction (i.e., a roller shaft direction, a thrust direction) perpendicular to the belt moving direction. Such belt drift can be prevented if the belt moves under desired conditions in which parallelism of the plurality of rollers, the thickness and the circumferential length of the belt, and the belt tension are equal without errors and deviation. However, it is difficult to achieve the desired conditions. When the belt drift occurs, the belt may slip off from the rollers.

To reduce the size of the image forming apparatus as a whole to accommodate limited space in offices, the dimension (height) of the transfer device tends to be made small.

Furthermore, for reduction of the cost of the transfer device, light-weight frames or frames made of resin are used. Although advantageous, with low stiffness, the mechanical strength of the frames of the transfer device is reduced, and thus the frames may deform or be bent upon installation of the transfer device in the image forming apparatus. Deformation of the frames causes misalignment of the belt, resulting in acceleration of belt drift and slippage from the rollers.

To address such difficulty, in order to move the belt entrained around the plurality of rollers without drifting, a guide member for guiding the belt is necessary. For example, in one approach, a guide member to restrict the belt drift is provided to the inner surface side and/or the outer surface side of the looped belt. If the guide member has the same circumferential length as the belt or longer, when the belt is bent or a blade-like part and the image bearing member come in contact with the inner surface or the outer surface of the belt, flatness and movability of the belt are degraded, causing image defects. For this reason, the length of the known guide member tends to be slightly shorter than the circumferential length of the belt.

When providing the guide member to the inner surface side of the belt, for example, the guide member is provided at both sides of the belt and runs on a groove formed at both sides of the rollers around which the belt is entrained. In another approach, the guide member is provided to both sides of the belt, and both end portions of the rollers guide the guide members to prevent the belt from drifting.

The guide member, a few millimeters shorter than the inner circumferential length of the belt, adhered to the inner surface of the belt using a both-sided tape, is more widely used than the guide member constituted as a single integrated member with the belt, which costs more than using the tape. In this configuration, the belt drift can be prevented without forming a groove on the rollers.

For stable and smooth movement of the belt, one of the rollers, which serves as a drive roller, does not move in the axial direction, and the other roller serving as a driven roller is configured movable in the axial direction. With this configuration, the belt-drift speed of is slowed down.

Although advantageous, if the drive roller and the driven roller are misaligned in the axial direction upon installation in the image forming apparatus, or the transfer device itself is misaligned in the axial direction, the belt is entrained around the rollers out of alignment over the moving direction. In particular, in a case in which the driven roller serves also as a tension roller and is urged by a tension application member such as a compression spring and a tension spring so as to bias the belt, the pressing direction of the rollers against the belt changes depending on dimension errors of the transfer device and the orientation of the rollers when urged by the tension application member. For this reason, it is difficult to align the drive roller and the belt in the axial direction.

In the meantime, because the belt is tensioned, a force that causes the belt to be stretched taut in the moving direction acts on the driven roller via the guide member when the belt moves. If the drive roller does not move in the axial direction, the driven roller is positioned in place at a position at which these two forces due to rotation of the belt are balanced. However, because the guide member is shorter than the circumferential length of the belt member and there is a place on the circumference of the belt where no guide member is provided (which is near the end portion of the guide member), when the place, where no guide member is provided, arrives at the driven roller and the drive roller, these two forces are no longer balanced, and hence a force in the axial direction acts momentarily on the driven roller. When this force is relatively large, the driven roller shifts in the axial direction, causing the belt to drift and hence resulting in color drift in the main scanning direction.

The belt drift causes misalignment of toner images when transferred from the image bearing members to the intermediate transfer belt. When the belt serves as the conveyor belt which carries a recording medium, the belt drift causes misalignment of the toner images transferred onto the recording medium, causing also color drift.

In view of the above, there is thus an unsolved need for an image forming apparatus capable of maintaining alignment of a belt entrained around a plurality of rollers.

SUMMARY OF THE INVENTION

In view of the foregoing, in an aspect of this disclosure, there is provided an improved image forming apparatus including a housing, a transfer unit, a positioning member, and a restriction member. The transfer unit transfers the toner image onto a recording medium and is detachably attachable relative to the housing. The transfer unit includes a drive roller driven by a gear to rotate about a shaft, a driven roller disposed opposite the drive roller, to rotate about a shaft, a belt formed into a loop and entrained around the drive roller and the driven roller, a frame to support the shaft of the drive roller, a support member to movably support the shaft of the driven roller to be parallel to an axial direction of the drive roller and movable in a first direction different from the axial direction. The positioning member disposed in the housing holds the shaft of the drive roller parallel as the transfer unit is mounted in the image forming apparatus. The restriction member disposed in the housing restricts movement of the driven roller in the first direction so as to keep the shaft of the driven roller parallel to the shaft of the drive roller as the transfer unit is mounted in the housing of the image forming apparatus.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
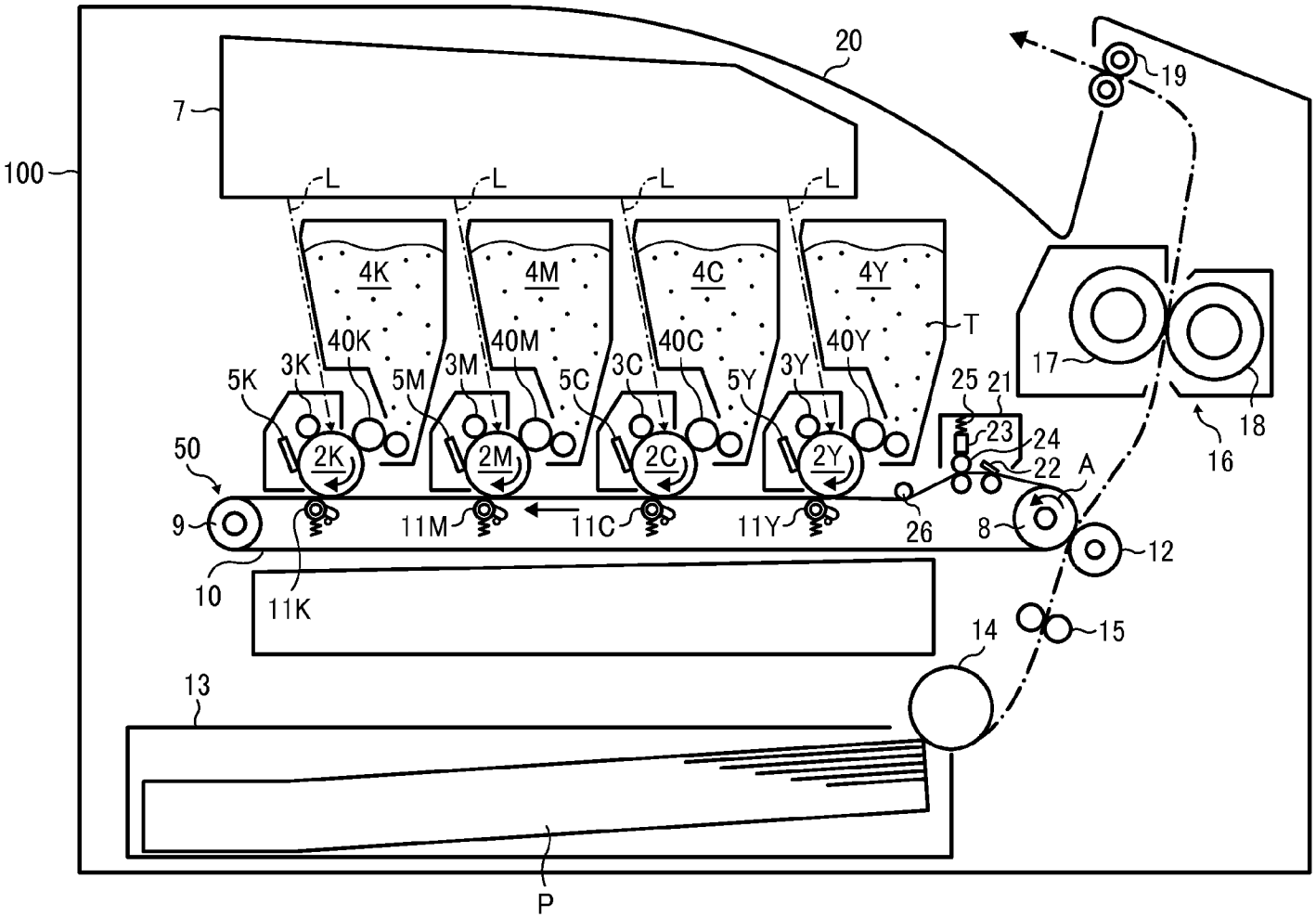
FIG. 1 is a cross-sectional diagram schematically illustrating an example of an image forming apparatus according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating a color printer as an example of an image forming apparatus using an intermediate transfer method according to an illustrative embodiment of the present invention. The image forming apparatus includes a housing 100 serving as a printer main body which houses an intermediate transfer unit 50, charging rollers 3Y, 3C, 3M, and 3K, developing devices 4Y, 4C, 4M, and 4K, a secondary transfer roller 12 serving as a secondary transfer device, a fixing device 16, a sheet tray 13, a belt cleaning device 21, and so forth.

The intermediate transfer unit 50 includes photosensitive drums 2Y, 2C, 2M, and 2K serving as image bearing members, one for each of the colors yellow, magenta, cyan, and black, respectively, a drive roller 8 that rotates in a direction indicated by arrow A, a driven roller 9, a transfer bias application mechanism including primary transfer rollers 11Y, 11C, 11M, and 11K, and an intermediate transfer belt 10 facing the photosensitive drums 2Y, 2C, 2M, and 2K, entrained around and stretched taut by the drive roller 8 and the driven roller 9. As the drive roller 8 rotates, the intermediate transfer belt 10 is moved in the direction of arrow in FIG. 1. The charging rollers 3Y, 3C, 3M, and 3K charge the photosensitive drums 2Y, 2C, 2M, and 2K, respectively. The charged surface of each of the photosensitive drums 2Y, 2C, 2M, and 2K are illuminated with exposure light L modulated based on image information, thereby forming an electrostatic latent image on each surface.

The developing devices 4Y, 4C, 4M, and 4K develop the electrostatic latent images formed on the photosensitive drums 2Y, 2C, 2M, and 2K with respective color of toner T, thereby forming a toner image on the photosensitive drums. Subsequently, the toner images are transferred onto the intermediate transfer belt 10 by the primary transfer rollers 11Y, 11C, 11M, and 11K, supplied with a bias electric current, such that they are superimposed one atop the other, forming a composite toner image on the intermediate transfer belt 10 in a process known as primary transfer. The secondary transfer roller 12 transfers the composite toner image on the intermediate transfer belt 10 onto a recording medium P. Subsequently, the composite toner image is fixed on the recording medium with heat and pressure applied by the fixing device 16. Multiple recording media is stored in the sheet tray 13. The belt cleaning device 21 cleans the surface of the intermediate transfer belt 10 after transfer.

It is to be noted that suffixes Y, M, C, and K denote colors yellow, magenta, cyan, and black, respectively, and to simplify the description, these suffixes may be omitted. The housing 100 of the image forming apparatus includes an opening at one side (the right hand side in FIG. 1) in a direction in which the photosensitive drums 2 are arranged in tandem. The intermediate transfer unit 50 is detachably attachable from the opening.

According to the present illustrative embodiment, the intermediate transfer unit 50 includes the drive roller 8, the driven roller 9, the intermediate transfer belt 10, and the primary transfer rollers 11Y, 11C, 11M, and 11K. The intermediate transfer unit 50 is detachably attachable relative to the housing 100 of the image forming apparatus.

The belt cleaning device 21 includes a cleaning blade 22 made of urethane rubber which contacts the surface of the intermediate transfer belt 10 to remove the residual toner therefrom. In the belt cleaning device 21, a solid lubricant 23 is pressed against a lubricant applicator 24 by a pressing member 25 formed of an elastic member such as a spring so that the lubricant applicator 24 scrapes and applies the solid lubricant 23 to the surface of the intermediate transfer belt 10 to facilitate cleaning. The pressing member 25 presses the solid lubricant against the lubricant applicator 24 at a certain pressure. In order to prevent the intermediate transfer belt 10 from vibrating when the lubricant applicator 24 applies the lubricant thereto, the intermediate transfer belt 10 is pressed inward by a pressing roller 26 from outside the loop formed by the intermediate transfer belt 10. The pressing roller 26 presses the intermediate transfer belt 10 from outside the loop.

According to the present illustrative embodiment, the pressing roller 26 is disposed outside the looped intermediate transfer belt 10. Alternatively, the pressing roller 26 may be disposed inside the loop of the belt to press the intermediate transfer belt 10 towards outside the loop. The same effect can be achieved.

The primary transfer rollers 11Y, 11C, and 11M for color imaging are movable by a moving member such that the primary transfer rollers 11Y, 11C, and 11M can contact and separate from the intermediate transfer belt 10. More specifically, during color imaging, the primary transfer rollers 11Y, 11C, and 11M, which are separated from the intermediate transfer belt 10 during monochrome imaging, contact the intermediate transfer belt 10, thereby pressingly stretching the intermediate transfer belt 10 to contact the photosensitive drums 2Y, 2C, 2M, and 2K. The primary transfer roller 11K for monochrome imaging contacts the intermediate transfer belt 10 without the moving device.

The secondary transfer roller 12 contacts the drive roller 8 via the intermediate transfer belt 10, thereby forming a secondary transfer nip between the secondary transfer roller 12 and the intermediate transfer belt 10. A driving force is applied to a rotary shaft of the secondary transfer roller 12 by a driving gear. The peripheral speed of the rotary shaft is substantially the same as the peripheral speed of the intermediate transfer belt 10. A secondary transfer bias is applied to the secondary transfer roller 12.

Still referring to FIG. 1, a description is provided of image forming operations according to the illustrative embodiment. An original-image signal formed in an external device such as a personal computer is sent to an image processor in which the original-image signal is converted to an input signal which then modulates exposure light (a laser beam) L. A light projecting device 7 illuminates the charged surfaces of the photosensitive drums 2Y, 2C, 2M, and 2K charged by the charging rollers 3Y, 3C, 3M, and 3K with the exposure light L through raster illumination. When the surface of the photosensitive drums 2 are illuminated with the exposure light L through raster illumination, the potential of the illuminated portion of the surface drops, thereby forming an electrostatic latent image on the photosensitive drums 2 in accordance with the input image signal.

The electrostatic latent images formed on the photosensitive drums 2Y, 2M, C, and 2K are developed with the respective color of toner T supplied by developing rollers 40Y, 40M, 40C, and 40K of the developing devices 4Y, 4C, 4M, and 4K, respectively, into visible images, also known as toner images. A primary transfer bias is applied to the primary transfer rollers 11Y, 11C, 11M, and 11K so that the toner images on the surface of the photosensitive drums 2Y, 2C, 2M, and 2K are transferred primarily onto the intermediate transfer belt 10 rotated by the drive roller 8 rotating in the direction of arrow A such that they are superimposed one atop the other, thereby forming a composite toner image on the intermediate transfer belt 10 in a process known as a primary transfer process.

In the meantime, a recording medium P stored in the sheet tray 13 is fed to the secondary transfer nip between the intermediate transfer belt 10 and the secondary transfer roller 12 by a sheet feed roller 14 and a pair of registration rollers 15. The secondary transfer roller 12 applied with the secondary transfer bias transfers the composite toner image on the intermediate transfer belt 10 to the recording medium P.

The recording medium P bearing the toner image is delivered to the fixing device 16. The fixing device 16 includes a fixing roller 17 and a pressing roller 18 pressingly contacts the fixing roller 17, thereby forming a fixing nip therebetween. In the fixing nip, heat and pressure are applied to the unfixed toner image on the recording medium P to fix the unfixed toner image thereon. Accordingly, a desired image is obtained.

After fixing, the recording medium on which the image is fixed is output onto a sheet output tray 20 at the upper portion of the housing 100 by a pair of sheet output rollers 19. Substances adhered to the intermediate transfer belt 10 such as residual toner remaining on the intermediate transfer belt 10 are removed by the belt cleaning device 21 in preparation for the subsequent imaging cycle, thereby completing the imaging cycle for a sheet of recording medium P. One job includes a series of imaging cycles executed for a preset number recording media sheets from the initial imaging cycle.

Residual toner, not having been transferred, thus remaining on the photosensitive drums 2Y, 2C, 2M, and 2K is removed by drum cleaners 5Y, 5C, 5M, and 5K.

Figure 2:
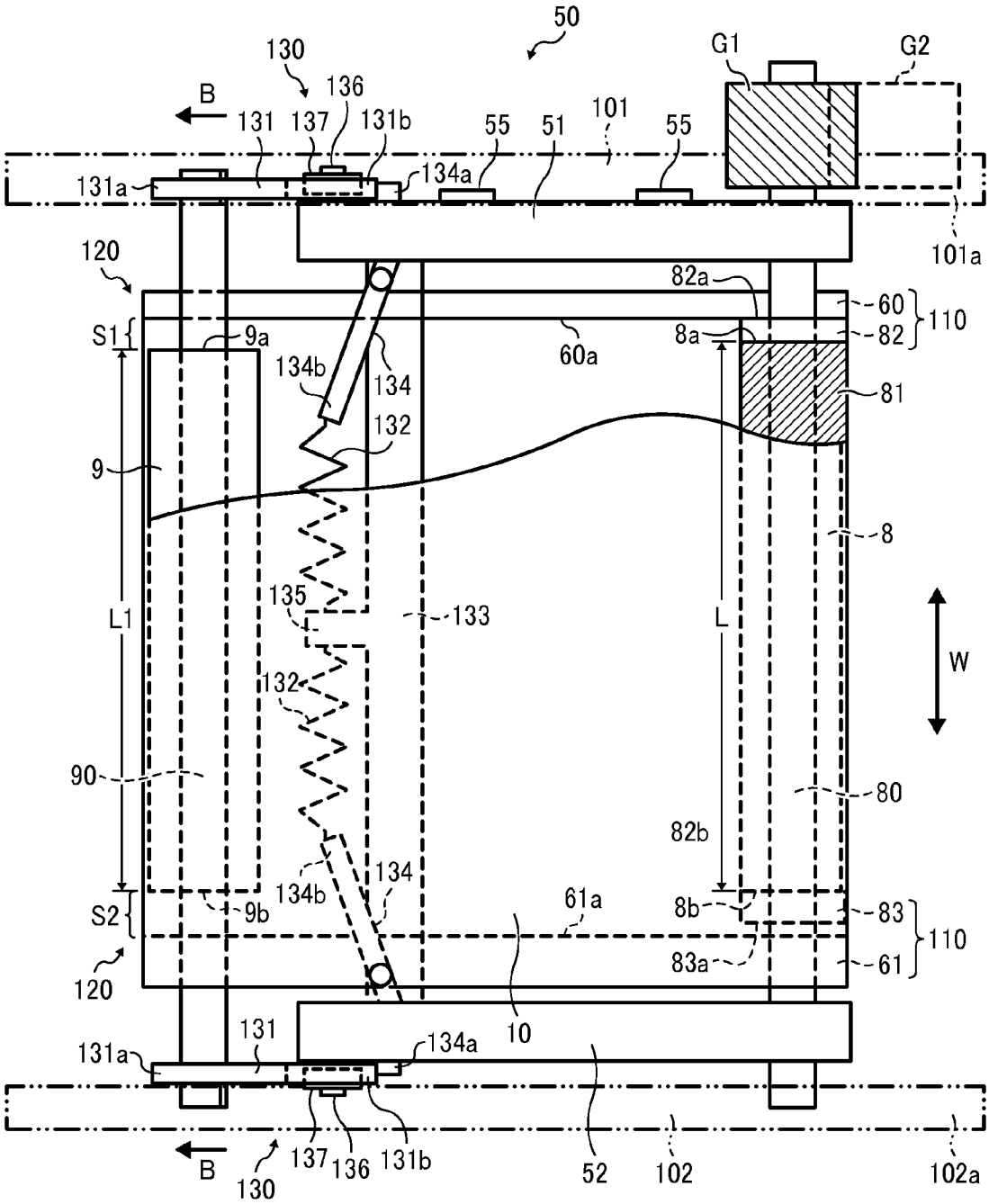
FIG. 2 is a top view schematically illustrating an intermediate transfer unit employed in the image forming apparatus of FIG. 1.
Figure 3:
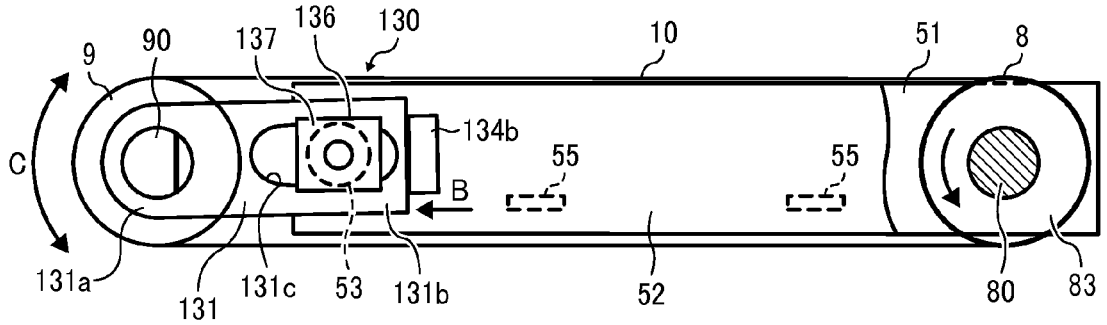
FIG. 3 is a cross-sectional view schematically illustrating the intermediate transfer unit and a support mechanism for a driven roller.

Next, with reference to FIGS. 2 and 3, a description is provided of the intermediate transfer unit 50. FIG. 2 is a top view schematically illustrating the intermediate transfer unit 50 employed in the image forming apparatus. FIG. 3 is a cross-sectional view schematically illustrating the intermediate transfer device 50 and a support mechanism for the driven roller 9.

As illustrated in FIGS. 2 and 3, the intermediate transfer belt 10 is entrained around the drive roller 8 and the driven roller 9. When mounted in the housing 100 of the image forming apparatus, the intermediate transfer belt 10 is moved in the counterclockwise direction by a drive motor. A process linear velocity of the intermediate transfer belt 10 is adjusted to approximately 150 mm/sec.

As illustrated in FIG. 2, the drive roller 8 includes a shaft 80 extending in a width direction indicated by a double-headed arrow W, a rubber layer 81 disposed on an outer surface of the shaft 80, and collars 82 and 83, each of which disposed at each end of the rubber layer 81 in the axial direction of the drive roller 8. As will be described later in detail, together with guide members 60 and 61, the collars 82 and 83 constitute a first belt-drift adjusting assembly 110 that adjusts the position of the intermediate transfer belt 10 in the axial direction. In the present illustrative embodiment, the width direction W coincides with the axial direction of the shaft 80.

According to the present illustrative embodiment, the intermediate transfer unit 50 includes a support member 130, and frames 51 and 52 that support the shaft 80 of the drive roller 8. The support member 130 supports a shaft 90 of the driven roller 9 parallel to the shaft 80 of the drive roller 8 in the width direction W while movably supporting the shaft 90 in a direction of arrow C illustrated in FIG. 3 which is a direction different from the width direction W.

The frames 51 and 52 rotatably support the drive roller 8 and the primary transfer rollers 11Y, 11C, 11M, and 11K. More specifically, the shaft 80 of the drive roller 8 is rotatably supported by the frame 51 and 52 via shaft bearings. It is to be noted that to simplify the description, the primary transfer rollers 11Y, 11C, 11M, and 11K are omitted in FIGS. 2 and 3.

According to the present illustrative embodiment, the collars 82 and 83 are provided between end surfaces 8*a* and 8*b* in the axial direction, and the guide members 60 and 61. More specifically, the collar 82 is disposed between the end surface 8*a* and the guide member 60. The collar 83 is disposed between the end surface 8*b* and the guide member 61. With this configuration, when the intermediate transfer belt 10 drifts out of alignment in the axial direction, the guide members 60 and 61 come into contact with the collars 82 and 83, respectively, thereby restricting movement of the intermediate transfer belt 10 in the axial direction.

Alternatively, no collars 82 and 83 may be provided. In such a case, the guide members 60 and 61 are disposed facing the end surfaces 8*a* and 8*b*, and when the intermediate transfer belt 10 drifts in the axial direction, the guide members 60 and 61 contact directly the end surfaces 8*a* and 8*b*, respectively, to restrict movement of the intermediate transfer belt 10 in the axial direction. In this configuration, the end surfaces 8*a* and 8*b*, and the guide members 60 and 61 constitute the belt-drift adjusting assembly 110.

As illustrated in FIG. 2, an input gear G1 is fixed to one end of the shaft 80 to drive the drive roller 8. When the intermediate transfer unit 50 is mounted in the housing 100 of the image forming apparatus, the input gear G1 meshes with a drive gear G2 which is driven by a drive motor. According to the present illustrative embodiment, the input gear G1 and the drive gear G2 employ helical gears which allow smooth and quiet transmission of a drive force to the drive roller 8, and at the same time, the position of the drive roller 8 in the axial direction is restricted in one direction. When driving the intermediate transfer belt 10 by the helical gears, a thrust force acts on the drive roller 8, thereby stabilizing the positions of the frames 51 and 52 including the drive roller 8. Accordingly, reliable movement of the intermediate transfer belt 10 is obtained, which results in reliable imaging.

As illustrated in FIG. 2, the guide members 60 and 61 are each provided at each side of the intermediate transfer belt 10 in the width direction W and adhered to the inner surface of the intermediate transfer belt 10 using a double-sided tape or the like. Each of the guide members 60 and 61 includes a single-layer or multiple layers made of urethane rubber or the like to enhance wear resistance. According to the present illustrative embodiment, a side surface 82*a* of the collar 82 and a side surface 83*a* of the collar 83 regulate the position of an inner surface 60*a* of the guide member 60 and an inner surface 61*a* of the guide member 61, respectively.

According to the present illustrative embodiment, the guide members 60 and 61 adhered to the inner surface of the intermediate transfer belt 10 prevent the intermediate transfer belt 10 from drifting. However, the present invention is not limited to the above-described configurations. The guide members 60 and 61 may be adhered to an outer surface of the intermediate transfer belt 10, or the collars 82 and 83 contact directly the end portions of the intermediate transfer belt 10 to regulate the position thereof. With this configuration, the same effect can be achieved.

As illustrated in FIG. 2, the driven roller 9 serves as a tension roller and rotatably supported by the shaft 90 extending in the width direction of the recording medium P. In the present illustrative embodiment, the width direction W coincides with the axial direction of the shaft 90.

A length L1 of the driven roller 9 is shorter than a length L of the drive roller 8 so that the driven roller 9 does not contact the guide members 60 and 61 even when the collar 82 contacts the guide member 60 or the collar 83 contacts the guide member 61, urging the roller in the axial direction. That is, the center portion of the intermediate transfer belt 10 in the axial direction W is closer to end surfaces 9*a* and 9*b* of the driven roller 9 than to the end surfaces of 8*a* and 8*b* of the drive roller 8.

According to the present illustrative embodiment, the end surfaces 9*b* and 9*a* of the driven roller 9, and the guide members 60 and 61 constitute a second belt-drift adjusting assembly 120. The length L1 of the driven roller 9 is configured such that when the collars 82 and 83 of the drive roller 8 are in contact with the guide members 60 and 61, respectively, gaps S1 and S2 are formed between the end surfaces 9*a* and 9*b*, and the guide members 60 and 61 so that the end surfaces 9*a* and 9*b* of the driven roller 9 do not contact the guide members 60 and 61.

The length L1 of the driven roller 9 is shorter than the length L of the drive roller 8, and the gaps S1 and S2 are formed between the end surfaces 9*a* and 9*b* of the driven roller 9, and the inner surfaces 60*a* and 61*a* of the guide members 60 and 61 when a center line that divides the length of the driven roller 9 into half and a center line that divides the length of the drive roller 8 into half are arranged on the same line.

Alternatively, each of the collars 82 and 83 may be disposed at each end of the shaft 90 of the driven roller 9. The collars 82 and 83, and the guide members 60 and 61 may constitute the second belt-drift adjusting assembly 120. In this case, while the collars 82 and 83 of the drive roller 8 are in contact with the guide members 60 and 61, preferably, the collars 82 and 83 of the shaft 90 are not in contact with the guide members 60 and 61.

If the positions of the above-described drive roller 8 and the driven roller 9 deviate in the axial direction in the intermediate transfer unit 50 alone when detached from the housing 100 or as the intermediate transfer unit 50 is mounted in the housing 100, the intermediate transfer belt 10 is entrained obliquely or out of alignment around the rollers in the moving direction of the belt, causing the belt to drift. This state persists in the intermediate transfer unit 50.

In the meantime, the intermediate transfer belt 10 is tensioned in the direction indicated by arrow B by the driven roller 9 so that as the intermediate transfer belt 10 moves, a force that causes the intermediate transfer belt 10 to be stretched straight in the direction of movement thereof acts on the driven roller 9 via the guide members 60 and 61. If the drive roller 8 does not move in the axial direction, the driven roller 9 is positioned in place at a position at which the two forces described above due to rotation of the intermediate transfer belt 10 are balanced.

However, the guide members 60 and 61 are shorter than the inner circumferential length of the intermediate transfer belt 10, and there is a place on the circumference of the belt where no guide member is provided (which is near the end portion of the guide members). Thus, when the portion of the belt at which no guide member is provided arrives at the driven roller 9 and the drive roller 8, the above described forces are no longer balanced, and hence a force in the axial direction acts momentarily on the driven roller 9. When this force is relatively large, the driven roller 9 drifts in the axial direction, causing a positional deviation of the intermediate transfer belt 10 in the pitch thereof. As a result, the movement of the intermediate transfer belt 10 is degraded, which results in color drift in the main scanning direction.

In view of the above, according to the present illustrative embodiment, because the guide members 60 and 61 are spaced a certain distance from the end surfaces 9*a* and 9*b* of the driven roller 9, even when the driven roller 9 drifts in the axial direction in the intermediate transfer unit 50 alone or upon installation of the intermediate transfer unit 50 in the housing 100, the movement of the intermediate transfer belt 10 is not degraded.

That is, a regulating force of the second belt-drift adjusting assembly 120 restricting the intermediate transfer belt 10 in the axial direction is less than that of the first belt-drift adjusting assembly 110.

As the first and the second belt-drift adjusting assemblies, alternatively, a known configuration, in which flanges are provided coaxially to the drive roller 8 and the driven roller 9 on the same axis, and a biasing device biases the flanges against the intermediate transfer belt 50 towards the rollers, may be employed.

As illustrated in FIG. 2, the support member 130 includes a pair of arms 131 and a pair of tension coil springs 132. Each end of the shaft 90 of the driven roller 9 is supported by a first end portion 131*a* of the arm 131. The opposed end of each of the arms 131, that is, a second end portion 131*b*, is movably supported relative to the frames 51 and 52 in the direction of arrow C and the direction of arrow B which is a direction of the tension applied to the intermediate transfer belt 10 by the driven roller 9 (hereinafter referred to as a tension application direction B). The pair of the tension coil springs 132 biases the arms 131 in the tension application direction B.

Figure 4:
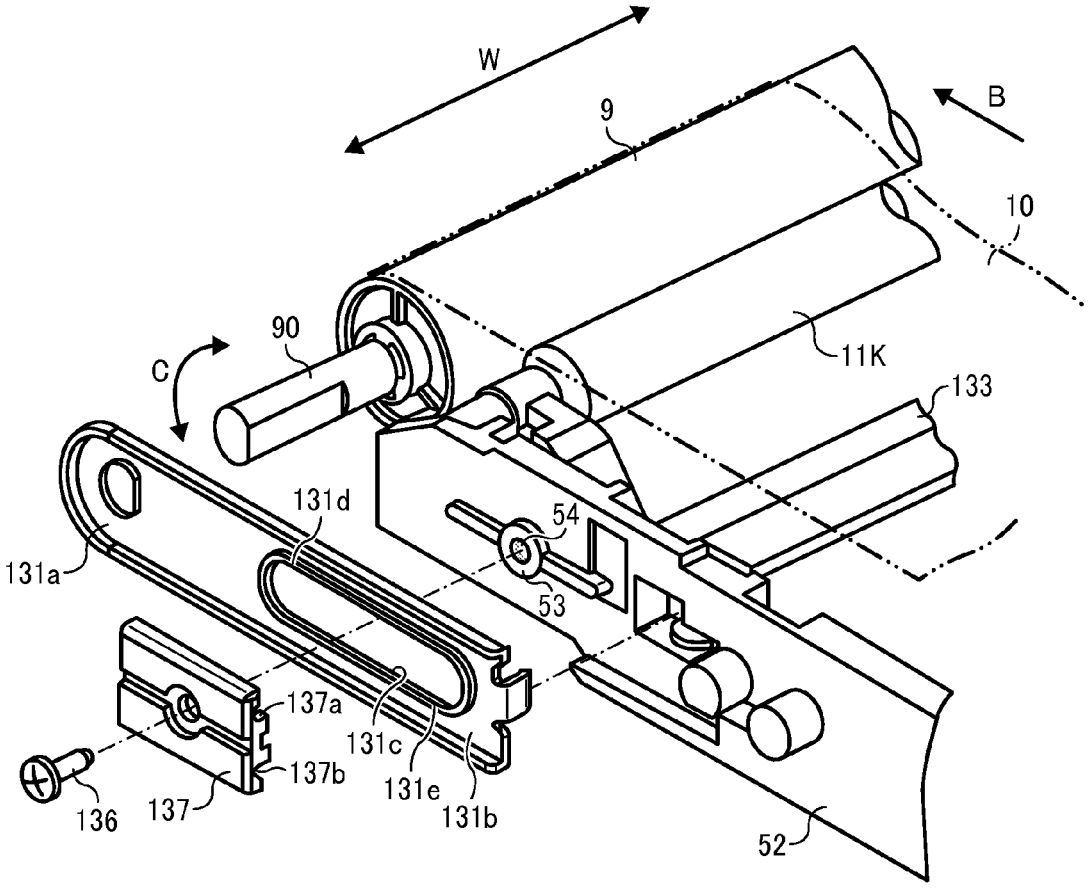
FIG. 4 is a partially enlarged perspective view schematically illustrating the support mechanism for the driven roller.

As illustrated in FIGS. 3 and 4, the second end portion 131*b* of each arm 131 includes a slot or an elongated hole 131*c* extending in the tension application direction B. As illustrated in FIG. 4, a boss 53 including a through hole 54 is formed on each of the frames 51 and 52 in a projecting manner out of the plane of the frames 51 and 52 in the axial direction and can be inserted into the slot 131*c*. To simplify the description, FIG. 4 only shows the boss 53 formed on the frame 52, because the boss 53 formed on the frame 51 has the same configuration. A support pin 136 is rotatably inserted into the through hole 54 of the boss 53 via a planar block member 137 from outside the frames 51 and 52.

As illustrated in FIG. 4, the slot 131*c* of each arm 131 includes an upper slide portion 131*d* at the upper portion of the slot 131*c* in the direction of arrow C and a bottom slide portion 131*e* opposite the upper slide portion 131*d*. The upper slide portion 131*d* and the bottom slide portion 131*e* extend in the tension application direction B and project out of a plane defined by the arm 131 in the width direction W. Each of the planar blocks 137 facing the arm 131 includes a pair of an upper groove 137*a* and a lower groove 137*b* serving as slide member bearing portions, extending in the tension application direction B. The upper groove 137*a* and the lower groove 137*b* movably support the slide portions 131*d* and 131*e* in the tension application direction B while the support pin 136 is inserted into the through hole 54 of the boss 53 and the block 137 is attached to the frames 51 and 52.

As illustrated in FIG. 4, the width of the upper groove 137*a* and the lower groove 137*b* in the vertical direction (the direction of arrow C) is larger than the width of the upper slide portion 131*d* and the lower slide portion 131*e* in the vertical direction. With this configuration, each arm 131 can move in the direction of arrow C relative to the block 137 and the frames 51 and 52 by an amount equal to the difference in the width between the width of the grooves 137*a* and 137*b*, and the width of the slide portions 131*d* and 131*e*. The groove depth of the slide portions 137*a* and 137*b* in the width direction W is greater than the amount of projection of the slide portions 131*d* and 131*e* in the width direction W. With this configuration, each arm 131 can move in the axial direction of the driven roller 9 relative to the block 137 and the frames 51 and 52 by an amount equal to the difference between the groove depth of the grooves 137*a* and 137*b*, and the amount of projection of the slide portions 131*d* and 131*e*.

As described above, each arm 131 is interposed between the block 137 and the frame 51 (52) with some allowance, allowing the arm 131 to move in the tension application direction B and swing in the direction of arrow C about the support pin 136. Furthermore, each arm 131 is supported movably in the axial direction of the driven roller 9. With this configuration, the driven roller 9 held by the arms 131 of the support member 130 via the shaft 90 can move in the tension application direction B and the direction of arrow C. It is to be noted that a portion of both end portions of the shaft 90 is D-shaped cross section and supported by the arm 131 to prevent the shaft 90 from rotating in the arm 131.

Referring back to FIG. 2, the frames 51 and 52 are linked by a connecting member 133. Operating arms 134 are rotatably supported by the connecting member 133. One end portion, that is, a first end portion 134*a* of each operating arm 134 contacts the second end portion 131*b* of each arm 131. One end portion of each of the tension coil springs 132 is hooked to a hook 135 formed substantially at the center of the connecting member 133. The opposed end of each tension coil spring 132 is hooked to a second end portion 134*b* opposite the first end portion 134*a*. In this configuration, the arms 131 are biased in the tension application direction B via the operating arms 134.

Figure 5:
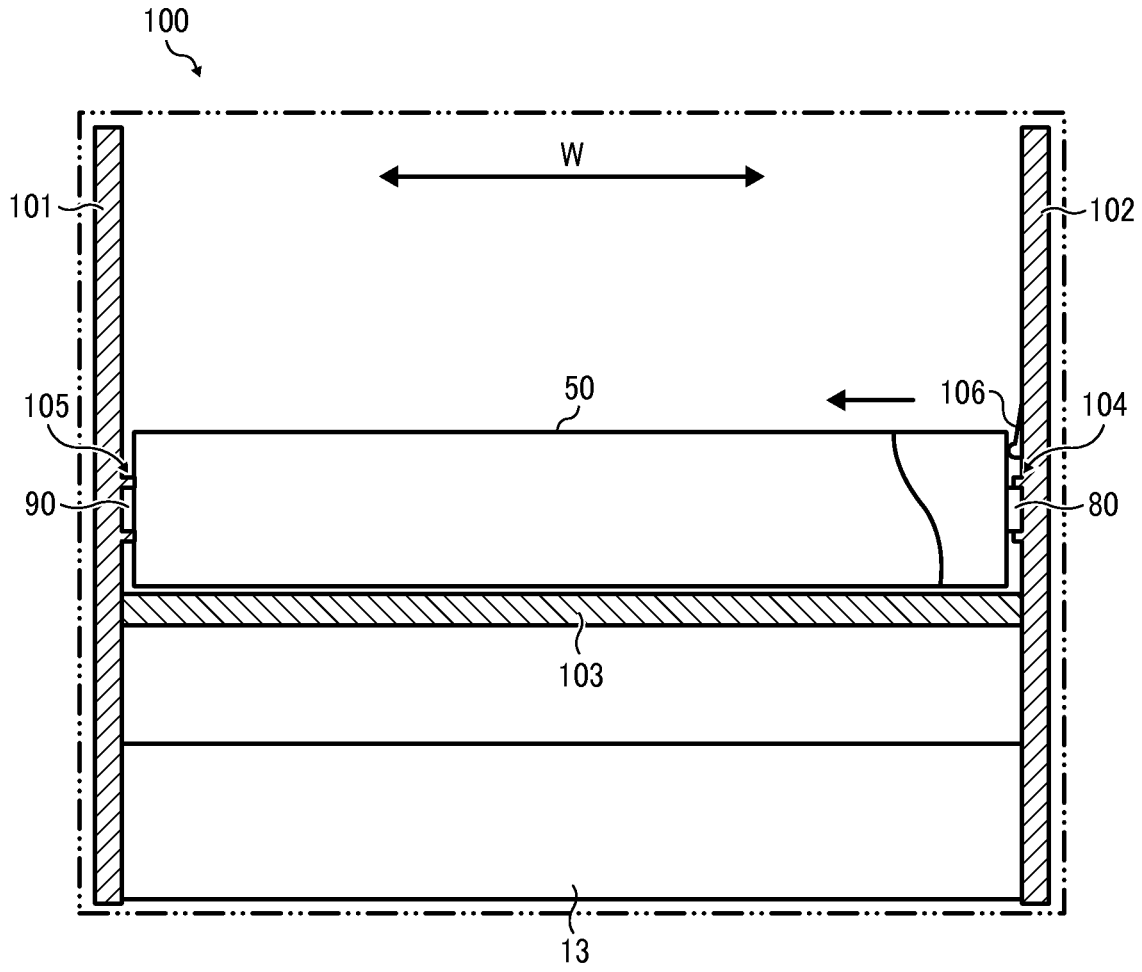
FIG. 5 is a schematic diagram illustrating side plates of the image forming apparatus.

As illustrated in FIG. 5, in the housing 100 of the image forming apparatus, metal side plates 101 and 102 are provided facing each other in the width direction (axial direction) W. FIG. 5 is a top view schematically illustrating the intermediate transfer unit 50, and the side plates 101 and 102 of the housing 100. The side plates 101 and 102 are connected by a dividing plate 103 so as to form an H-like shape. According to the present illustrative embodiment, the sheet tray 13 is disposed below the dividing plate 103, and the intermediate transfer unit 50 is disposed above the dividing plate 103.

A leaf spring 106 is attached to the side plate 102. The leaf spring 106 biases the intermediate transfer unit 50 towards the side plate 101. As the intermediate transfer unit 50 is mounted in the housing 100 of the image forming apparatus, positioning ribs 55 formed on the frame 51 of the intermediate transfer unit 50 are biased towards the side plate 102 due to the effect of the leaf spring 106, thereby positioning the intermediate transfer unit 50 in place in the axial direction of the roller.

In other words, the leaf spring 106 serves as a biasing member that biases the drive roller 8 in the axial direction. Furthermore, according to the present illustrative embodiment, the direction of bias exerted by the leaf spring 106 and the direction of bias applied to the drive roller 8 by the rotation of the input gear G1 and the drive gear G2 formed of helical gears are substantially the same. With this configuration, the position of the drive roller 8 in the axial direction can be more efficiently regulated as compared to the case in which the leaf spring 106 alone regulates the position of the drive roller 8 in the axial direction. Accordingly, more reliable and smooth belt movement is achieved, allowing stable image formation.

Figure 6:
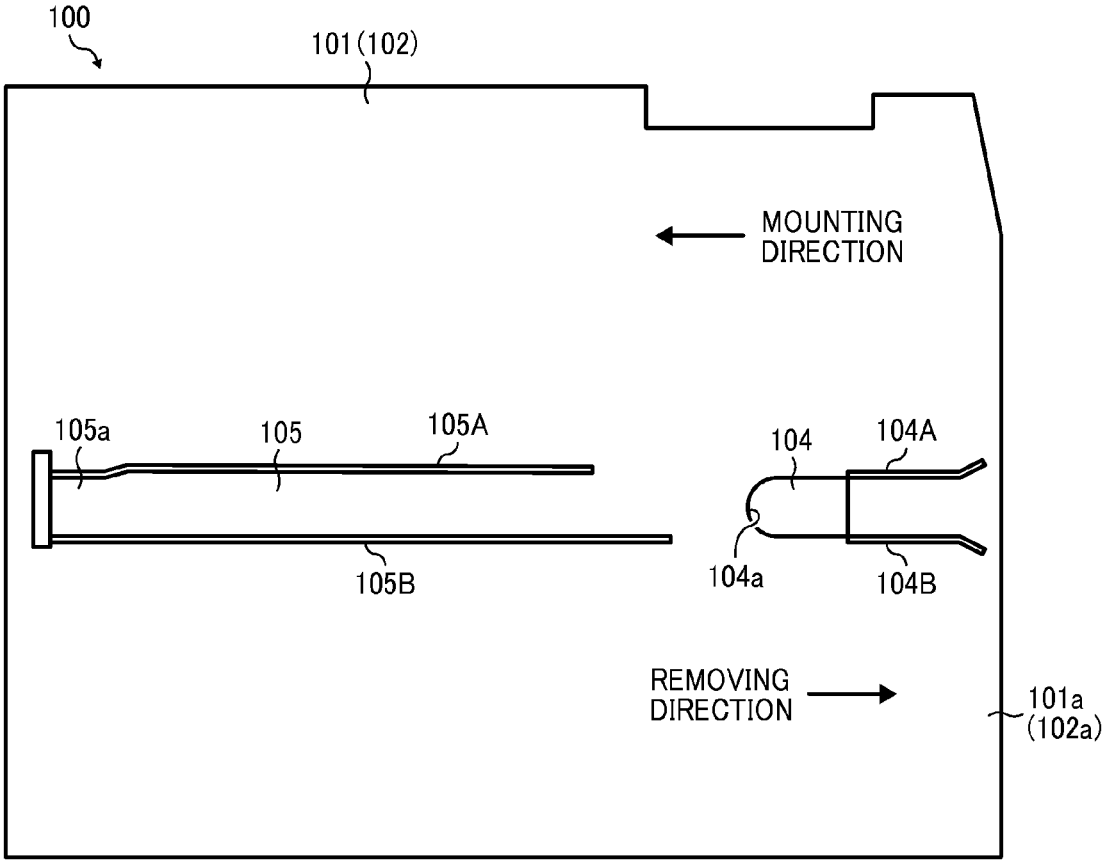
FIG. 6 is a side view schematically illustrating a positioning member and a restriction member provided to the side plates.

As illustrated in FIG. 6, each of the side plates 101 and 102 includes a positioning member 104 and a restriction member 105. As the intermediate transfer unit 50 is mounted in the housing 100, the positioning member 104 keeps the shaft 80 of the drive roller 8 parallel while the positioning portion 105 regulates movement of the driven roller 9 in the direction of arrow C to keep the shaft 80 of the drive roller 8 and the shaft 90 of the driven roller parallel to each other.

The positioning member 104 includes an elongated hole penetrating in the side plates 101 and 102, extending in the axial direction. Upper and lower guide ribs 104A and 104B are provided on the inner surface of each of the side plates 101 and 102 at a position between the positioning member 104, and side-plate end portions 101*a* and 102*a* of the side plates 101 and 102 at the proximal side in a mounting direction indicated by an arrow B1 or the mounting/removing side of the intermediate transfer unit 50. The guide ribs 104A and 104B guide the shaft 80 to the positioning member 104. The size of the positioning member 104 and the space between the guide ribs 104A and 104B are greater than the diameter of the shaft 80, thereby allowing both ends of the shaft 80 to move smoothly from the side-plate end portions 101*a* and 102*a* side to the distal side (at the left hand side of FIG. 6) of the housing 100 in the mounting direction B1. The positioning member 104 formed on the side plate 101 faces the positioning member 104 of the side plate 102 at the same height and has the same length as the positioning member 104 of the side plate 102. A removing direction opposite the mounting direction B1 is indicated by an arrow B2.

The restriction member 105 includes a groove defined by an upper guide rail 105A and a lower guide rail 105B formed on the inner surface of the side plates 101 and 102. The upper guide rail 105A is disposed facing the lower guide rail 105B with a space therebetween. The space between the upper guide rail 105A and the lower guide rail 105B is slightly greater than the diameter of the shaft 90 of the driven roller 9 at the proximal side in the mounting direction B1, that is, at the side-plate end portions 101*a* and 102*a* side of the side plates 101 and 102. However, the space is narrowed at an end portion 105*a*. That is, the space is substantially the same size as the diameter of the shaft 90. The end portion 105*a* is formed such that when the positioning member 104 positions the shaft 80 of the drive roller 8 in place in the mounting direction B1, the shaft 90 of the driven roller 90 is positioned at the end portion 105*a*.

The upper guide rail 105A is shorter than the lower guide rail 105B at the proximal side or at the side-plate end portions 101*a* and 102*a* side, allowing the shaft 90 of the driven roller 9 to fall in the groove upon installation of the intermediate transfer unit 50 in the housing 100.

According to the present illustrative embodiment, the mounting direction B1 and the removing direction B2 of the intermediate transfer belt 10 relative to the housing 100 coincide with the tension application direction B applied to the intermediate transfer belt 10 by the driven roller 9. This direction is a substantially horizontal direction which is a direction in which the positioning member 104 and the restriction member 105 extend.

Figure 7:
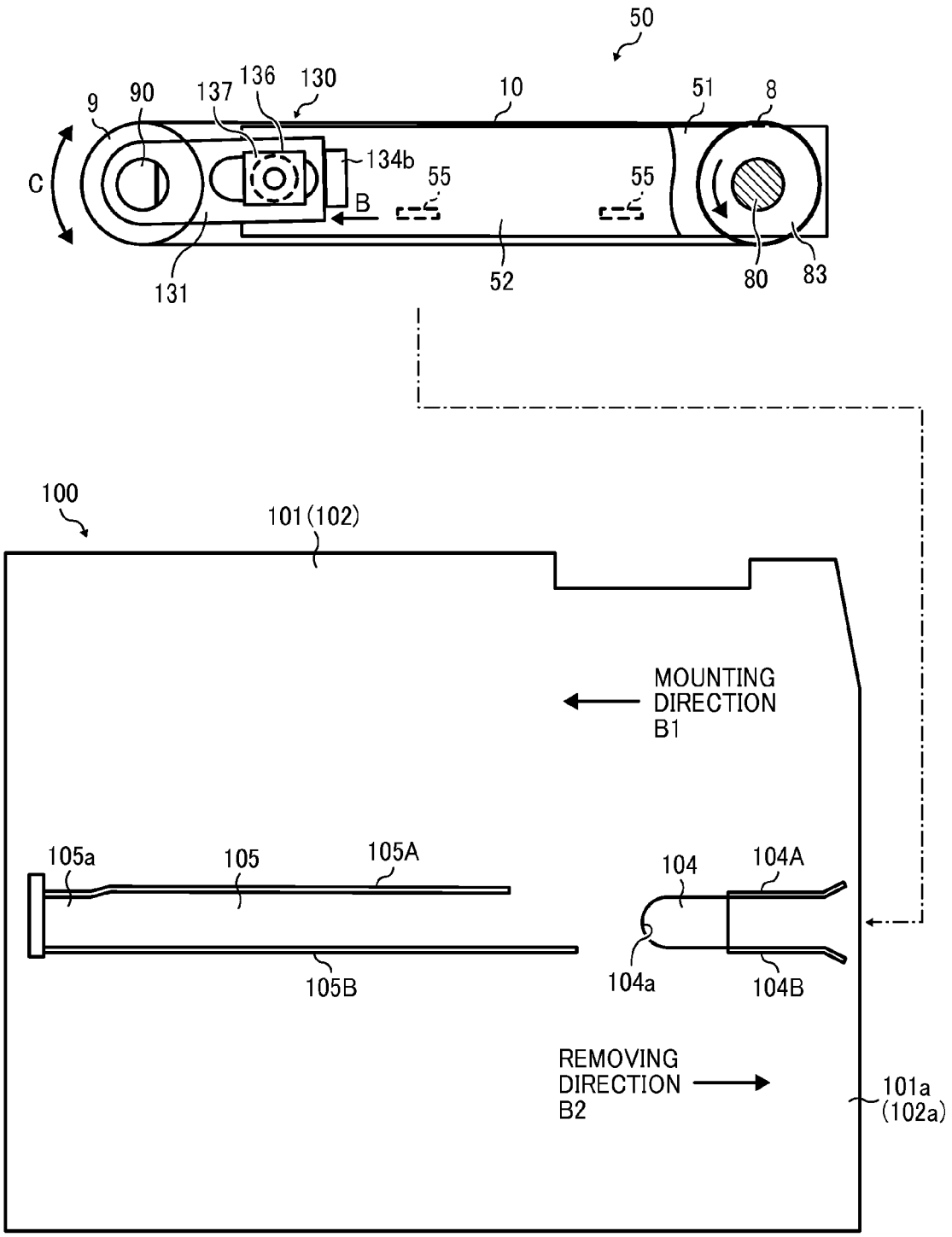
FIG. 7 is a side view schematically illustrating the intermediate transfer unit detached from the image forming apparatus.

With reference to FIG. 7, a description is provided of the intermediate transfer unit 50 detached from the housing 100. FIG. 7 is a side view schematically illustrating the intermediate transfer unit 50 detached from the housing 100. As illustrated in FIG. 7, when detached from the housing 100, the drive roller 8 is supported by the frames 51 and 52 so that the position thereof is fixed. By contrast, although the driven roller 9 is biased towards the intermediate transfer belt 10 in the tension application direction B, the driven roller 9 is supported movably relative to the frames 51 and 52 in the direction of arrow C by the support member 130. Accordingly, the driven roller 9 hangs from the support pin 136 under its own weight relative to the frame members 51 and 52. In this state, the shaft 80 of the drive roller 8 and the shaft 90 of the driven roller 9 are parallel to each other in the planar view. This state is elastically maintained so that the position of the shaft 90 of the driven roller 9 is changeable relative to the shaft 8 of the drive roller 80.

Figure 8:
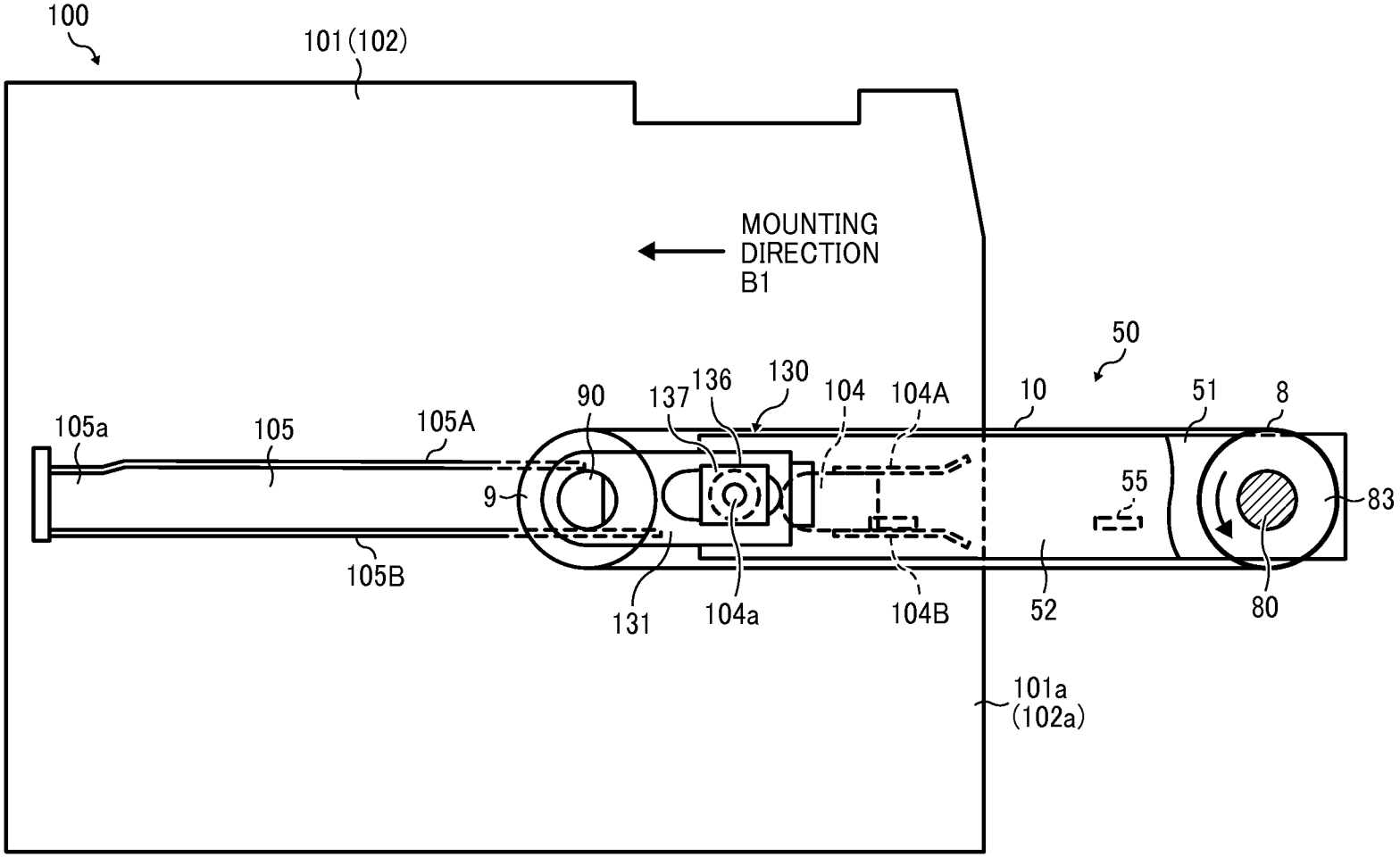
FIG. 8 is a side view schematically illustrating the intermediate transfer unit being mounted in the image forming apparatus.

From this state illustrated in FIG. 7, the intermediate transfer unit 50 is inserted into the housing 100 from the side-plate end portions 101*a* and 102*a* side as illustrated in FIG. 8. At this time, both ends of the shaft 90 are pushed into between the upper guide rail 105A and the lower guide rail 105B of the restriction member 105 formed on the side plates 101 and 102. As the intermediate transfer unit 50 moves in the mounting direction B1, both ends of the shaft 80 of the drive roller 8 are inserted between the upper guide rib 104A and the lower guide rib 104B.

Figure 9:
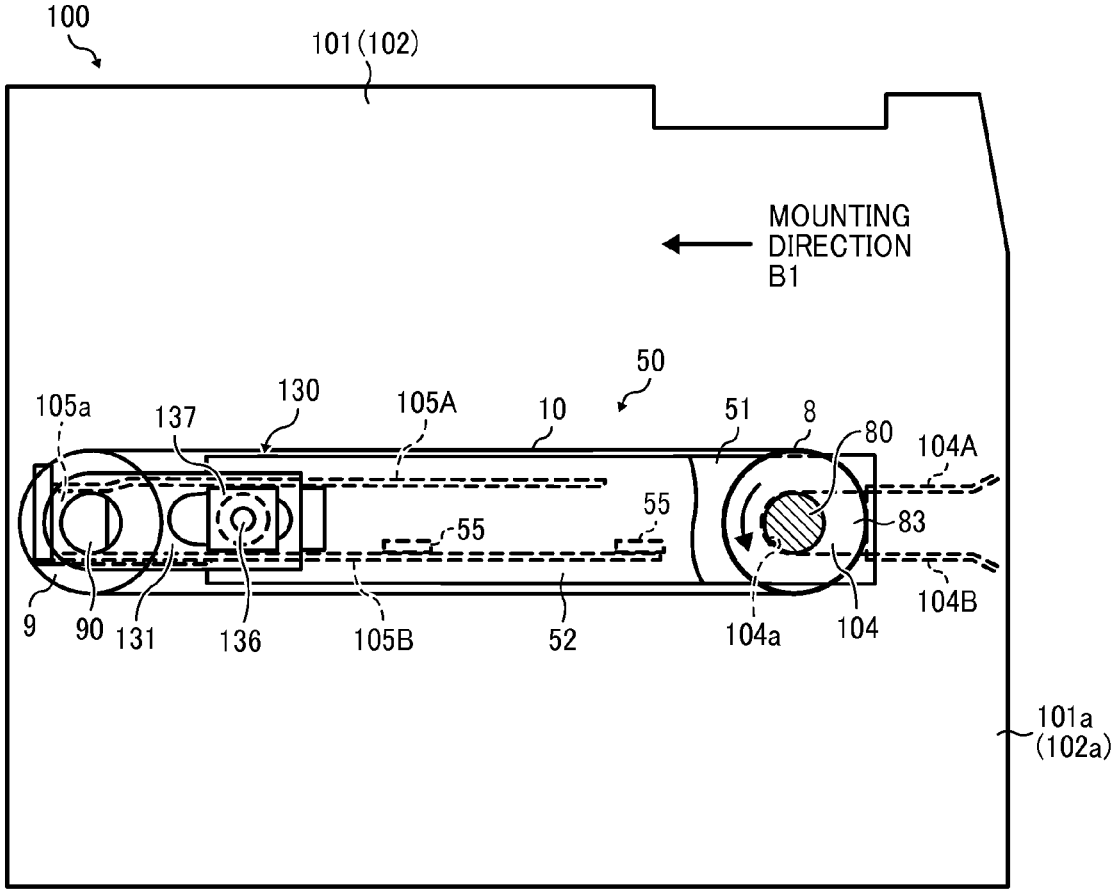
FIG. 9 is a side view schematically illustrating the intermediate transfer unit mounted completely in the image forming apparatus.

When the intermediate transfer unit 50 is moved further in the mounting direction B1 while the shaft 90 is inserted between the guide rails 105A and 105B and the shaft 80 is inserted between the guide ribs 104A and 104B, as illustrated in FIG. 9, the shaft 80 comes into contact with an end portion 104*a* of the positioning member 104, thereby stopping traveling of the shaft 80 and the intermediate transfer unit 50 in the mounting direction B1. Accordingly, the intermediate transfer unit 50 is positioned in place. When the movement of the shaft 80 in the mounting direction B1 is restricted, the shaft 90 is at the end portion 105*a* of the guide rails 105A and 105B. As described above, because the space between the guide rail 105A and the guide rail 105 is narrowed at the end portion 105*a*, that is, the end portion 105*a* has a similar or the same dimension as the diameter of the shaft 90, the shaft 90 is prevented from moving in the direction of arrow C. Accordingly, the shaft 90 is positioned in place.

As described above, the driven roller 9 is movable relative to the drive roller 8. In this configuration, the relative positions of the drive roller 8 and the driven roller 9 do not need to consider accumulation of parts in the intermediate transfer unit 50. With this configuration, upon installation of the intermediate transfer unit 50 in the image forming apparatus housing 100, the shaft 80 of the drive roller 8 and the shaft 90 of the driven roller 9 are positioned in place by the positioning member 104 and the restriction member 105 formed on the side plates 101 and 102. Accordingly, the drive roller 8 and the driven roller 9 are positioned at a desired position, that is, parallel to each other, without taking into account parts variations and deformation of parts in the intermediate transfer unit 50, thereby slowing belt-drift speed of the intermediate transfer belt 10. Deceleration of the belt-drift speed or prevention of drift of the intermediate transfer belt 10 allows reliable and smooth belt movement, resulting in stable imaging performance.

In the present illustrative embodiment, when the intermediate transfer unit 50 is detached from the housing 100 of the image forming apparatus, the driven roller 9 may be bent easily. When mounted in the housing 100, the intermediate transfer unit 50 is positioned in place by the positioning member 104 and the restriction member 105 formed on the side plates 101 and 102 so that the intermediate transfer unit 50, and the side plates 101 and 102 become a single integrated unit, thereby increasing stiffness. Without providing dimensional allowances to the intermediate transfer unit 50, accumulation of dimensional tolerances of parts causes assembly variations, which result in deviations and distortion of the intermediate transfer unit 50. In order to reduce such variations, strict control of manufacturing accuracy is required. Furthermore, when the intermediate transfer unit 50 with distortion is mounted on the side plates 101 and 102 originally having high stiffness, the side plates 101 and 102 cannot compensate (absorb) the distortion.

In view of the above, in the present illustrative embodiment, the stiffness of the intermediate transfer unit 50 is intentionally reduced by making the driven roller 9 movable via the support member 130. When mounted on the side plates 101 and 102, the driven roller 9 is aligned along the positioning member 104 and the restriction member 105, thereby aligning accurately with respect to the side plates 101 and 102 (the positioning member 104 and the restriction member 105). With this configuration, the accuracy control of the intermediate transfer unit 50 does not have to be strict, and distortion or twisting of the intermediate transfer unit 50 is reduced, if not prevented entirely, when mounted in the housing 100. The intermediate transfer belt 10 is prevented from drifting in the axial direction or drifting out of alignment. In other words, distortion of the driven roller 9 relative to the drive roller 8 can be reduced, thereby maintaining the shaft 90 parallel to the shaft 80 of the drive roller 8.

The drive roller 8 and the driven roller 9 is maintained parallel to each other by mounting the shaft 80 and the shaft 90 on the side plates 101 and 102, thereby preventing the belt drift. In a case in which the belt drift occurs due to a wrapping position of the intermediate transfer belt 10 around the rollers while the drive roller 8 and the driven roller 9 are mounted on the side plates 101 and 102, the guide members 60 and 61 contact the collars 82 and 83 provided to the shaft 80 of the drive roller 8 so that the drive roller 8 is prevented from moving in the axial direction.

As for the driven roller 9, if the guide members 60 and 61 do not contact partially the end surfaces 9*a* and 9*b* of the driven roller 9, the driven roller 9 drifts in the axial direction. Thus, the end surfaces 9*a* and 9*b* of the driven roller 9 are configured not to contact the guide members 60 and 61. Accordingly, the belt drift in the axial direction caused by the end surfaces 9*a* and 9*b* of the driven roller 9 contacting the guide members 60 and 61 is prevented, hence preventing color drift.

The positions of the drive roller 8 and the driven roller 9 in the height direction (in the direction of arrow C) are aligned along the side plates 101 and 102 (the positioning member 104 and the restriction member 105) so that the parallelism error can be small. Furthermore, the restriction force of the second belt-drift adjusting assembly 120 at the driven roller 9 side to restrict the movement of the intermediate transfer belt 10 is less than that of the first belt-drift adjusting assembly 110 of the drive roller 8 side. With this configuration, the belt-drift speed of the intermediate transfer belt 10 is slowed, thereby providing smooth and reliable belt movement. According to the present illustrative embodiment, the arm 131 of the support member 130 supports movably the shaft 90 of the driven roller 9 in the direction of arrow C and the tension application direction B, and the arm 131 is biased in the tension application direction B by the tension coil spring 132, thereby enabling the driven roller 9 to serve as a tension roller. Accordingly, a designated tension roller is not required, reducing the number of parts and the cost. The belt-drift speed of the intermediate belt 10 is slowed, thereby reliably maintaining good belt movement.

According to the present illustrative embodiment, since the mounting direction B1 and the removing direction B2 of the intermediate transfer unit 50 relative to the housing 100 coincide with the tension application direction B applied to the intermediate transfer belt 10, the same parts that regulate movement of the driven roller 9 in the moving direction can be used for installation/removal of the intermediate transfer unit 50. This configuration allows size reduction.

In the present illustrative embodiment, while the end surfaces 8*a* and 8*b* of the drive roller 8 or the collars 82 and 83 of the drive roller 8 are in contact with the guide members 60 and 61, the end portions 9*a* and 9*b* of the driven roller 9 or the collars 82 and 83 for the driven roller 9 are not in contact with the guide members 60 and 61. With this configuration, the cost of the second belt-drift adjusting assembly 120 including the guide members 60 and 61, and the end surfaces 9*a* and 9*b* of the driven roller 9 or the collars 82 and 83 can be reduced, and yet reliable movement of the intermediate transfer unit 50 can be achieved. Images without defects such as color drift can be produced reliably.

According to the illustrative embodiments, the present invention is applied to the intermediate transfer unit 50 serving as a transfer device. The present invention can be also applied to a transfer-conveyer belt unit in which a conveyer belt surface carries the recording medium to which toner images are transferred. The same effect can be achieved.

The image forming apparatus that employs the transfer device of the illustrative embodiments is not limited to an electrophotographic image forming apparatus. The present invention can be applied to an image forming apparatus that forms an image by ejecting ink droplets from a nozzle against a recording medium P. In this case, the conveyer belt of the transfer device delivers the recording medium to a position opposite the nozzle tip.

The image forming apparatus is not limited to a color image forming apparatus, but may be a monochrome image forming apparatus.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a housing;

a transfer unit configured to transfer a toner image onto a recording medium, detachably attachable relative to the housing, the transfer unit including, a drive roller including a shaft about which the drive roller rotates, a driven roller opposite the drive roller, including a shaft about which the driven roller rotates, a belt formed into a loop and entrained around the drive roller and the driven roller, a frame to support the shaft of the drive roller, a support member configured to movably support the shaft of the driven roller to be parallel to an axial direction of the drive roller and movable in a first direction different from the axial direction, the support member including an arm member having a first end portion and a second end portion, the first end portion supporting the shaft of the driven roller and the second end portion being movably supported by the frame in the first direction and a second direction of application of tension to the belt by the driven roller, and a positioning member in the housing, the positioning member being configured to hold the shaft of the drive roller parallel to the shaft of the driven roller as the transfer unit is mounted in the image forming apparatus; and a restriction member in the housing, the restriction member being configured to restrict movement of the driven roller in the first direction so as to keep the shaft of the driven roller parallel to the shaft of the drive roller as the transfer unit is mounted in the housing of the image forming apparatus.

2. The image forming apparatus according to claim 1, wherein the support member further includes:

a biasing member to bias the arm member in the second direction.

3. The image forming apparatus according to claim 1, wherein the arm member is movably supported by the frame in the axial direction of the driven roller.

4. The image forming apparatus according to claim 1, wherein a direction of mounting and removal of the transfer device relative to the image forming apparatus coincides with the second direction.

5. The image forming apparatus according to claim 1, further comprising:

an input gear provided to the shaft of the drive roller; and a drive gear configured to mesh with the input gear as the transfer device is mounted in the image forming apparatus, wherein the input gear and the drive gears are helical gears.

6. The image forming apparatus according to claim 5, further comprising:

a roller biasing member configured to bias the drive roller in the axial direction thereof, wherein a direction of the bias applied by the roller biasing member coincides with a direction of a bias applied by rotation of the input gear and the drive gear.

7. The image forming apparatus according to claim 1, further comprising:

a first belt-drift adjusting assembly configured to adjust the position of the belt in the axial direction at the drive roller side; and a second belt-drift adjusting assembly configured to adjust the position of the belt in the axial direction at the driven roller side, wherein an adjusting force of the second belt-drift adjusting assembly to adjust movement of the belt is less than that of the first belt-drift adjusting assembly.

8. The image forming apparatus according to claim 7, further comprising:

a guide member inside the loop formed by the belt, wherein the first belt-drift adjusting assembly includes the guide member, and one of an end surface of the drive roller in the axial direction and a first collar member between the end surface of the drive roller and the guide member, and the second belt-drift adjusting assembly includes the guide member, and one of an end surface of the driven roller in the axial direction and a second collar member between the end surface of the driven roller and the guide member.

9. The image forming apparatus according to claim 8, wherein as the guide member contacts one of the end surface of the drive roller and the first collar member, the second belt-drift adjusting assembly is configured to prevent either the end surface of the driven roller or the second collar member from contacting the guide member.

10. The image forming apparatus according to claim 1, further comprising:

an image bearing member configured to bear a toner image on a surface thereof, wherein the transfer unit is an intermediate transfer unit including a transfer bias device configured to transfer the toner image from the image bearing member to an outer surface of the belt.

11. The image forming apparatus according to claim 1, further comprising:

an image bearing member configured to bear a toner image on a surface thereof, wherein the transfer unit is a transfer conveyer-belt unit in which an outer surface of the belt facing the image bearing member carries a recording medium, and the toner image is transferred from the image bearing member to the recording medium.

12. An image forming apparatus, comprising:

a housing;

a transfer unit configured to transfer a toner image onto a recording medium, detachably attachable relative to the housing, the transfer unit including, a drive roller including a first shaft, a driven roller opposite the drive roller, including a second shaft, a belt entrained around the drive roller and the driven roller, a frame configured to support the first shaft, a support portion supported by the frame, and a holding member configured to movably support the second shaft, the holding member including a slide portion configured to be able to slide along the support portion in a tension application direction to the belt, the holding member being an arm which includes a first end portion and a second end portion at an opposite end of the first end portion, the first end portion supports the second shaft and the second end portion is movably supported by the frame; and a restriction member in the housing, the restriction member being configured to restrict movement of the driven roller in a first direction, the first direction being different from the tension application direction and an axial direction of the drive roller, wherein a width of the support portion in the first direction is larger than a width of the slide portion.

13. The image forming apparatus according to claim 12, wherein a depth of the support portion in the axial direction is larger than a depth of the slide portion.

14. The image forming apparatus according to claim 12, wherein the support portion is a groove and the slide portion is a projection.

15. The image forming apparatus according to claim 12, further comprising:

a biasing member configured to bias the arm in the tension application direction.

16. The image forming apparatus according to claim 12, wherein the support portion is formed on a planar block which is attached to the frame.

17. The image forming apparatus according to claim 12, wherein the support portion and the slide portion extend in the tension application direction.

18. The image forming apparatus according to claim 12, further comprising:

a positioning member in the housing, the positioning member being configured to hold the first shaft parallel to the second shaft as the transfer unit is mounted in the image forming apparatus.

19. An image forming apparatus, comprising:

a housing;

a transfer unit configured to transfer a toner image onto a recording medium, detachably attachable relative to the housing, the transfer unit including, a drive roller including a first shaft, a driven roller opposite the drive roller, including a second shaft, a belt entrained around the drive roller and the driven roller, a frame to support the first shaft, a support portion supported by the frame, and a holding member configured to movably support the second shaft, the holding member including a slide portion configured to be able to slide along the support portion in a tension application direction to the belt, the holding member being an arm which includes a first end portion and a second end portion at an opposite end of the first end portion, the first end portion supports the second shaft and the second end portion is movably supported by the frame; and a restriction member in the housing, the restriction member being configured to restrict movement of the driven roller in a first direction, the first direction being different from the tension application direction and an axial direction of the drive roller, wherein the holding member is between the support portion and the frame and is configured to be able to move in the tension application direction and the first direction.

* * * * *